US007908706B2

(12) United States Patent
Hawkins et al.

(10) Patent No.: US 7,908,706 B2
(45) Date of Patent: Mar. 22, 2011

(54) UPRIGHT VACUUM CLEANER WITH CYCLONIC AIR PATH

(75) Inventors: Thomas Hawkins, Normal, IL (US); Rich Eisenmenger, Champaign, IL (US); Len Hampton, Normal, IL (US); Christer Kontio, Bloomington, IL (US)

(73) Assignee: Electrolux Home Care Products, Inc., Cleveland, OH (US)

( * ) Notice: Subject to any disclaimer, the term of this patent is extended or adjusted under 35 U.S.C. 154(b) by 0 days.

(21) Appl. No.: 12/037,396

(22) Filed: Feb. 26, 2008

(65) Prior Publication Data

US 2008/0263818 A1 Oct. 30, 2008

Related U.S. Application Data

(63) Continuation of application No. 11/758,824, filed on Jun. 6, 2007, now Pat. No. 7,334,290, which is a continuation of application No. 11/281,796, filed on Nov. 18, 2005, now Pat. No. 7,228,592, which is a continuation of application No. 10/430,603, filed on May 6, 2003, now abandoned, which is a continuation of application No. 09/759,391, filed on Jan. 12, 2001, now Pat. No. 6,910,245.

(60) Provisional application No. 60/176,374, filed on Jan. 14, 2000.

(51) Int. Cl.
*A47L 9/10* (2006.01)

(52) U.S. Cl. ..... 15/347; 15/351; 15/353; 55/337; 55/459.1; 55/521; 55/DIG. 3

(58) Field of Classification Search ..... 15/347, 15/349–353, 339; 55/459.1, 521, 337, DIG. 3; *A47L 9/10*

See application file for complete search history.

(56) References Cited

U.S. PATENT DOCUMENTS

| | | | | |
|---|---|---|---|---|
| 1,639,132 | A * | 8/1927 | Greene | 55/487 |
| 3,653,189 | A | 4/1972 | Miyake et al. | |
| 4,198,726 | A * | 4/1980 | Powell, Jr. | 15/312.2 |
| 4,665,582 | A * | 5/1987 | Richmond et al. | 15/344 |
| 4,967,443 | A | 11/1990 | Krasznai et al. | |
| 5,020,187 | A | 6/1991 | Kosten et al. | |
| 5,065,473 | A | 11/1991 | Krasznai et al. | |
| 5,211,846 | A * | 5/1993 | Kott et al. | 210/232 |
| 5,248,323 | A * | 9/1993 | Stevenson | 95/90 |
| 5,855,634 | A * | 1/1999 | Berfield | 55/472 |
| 6,442,792 | B1 | 9/2002 | Sudou et al. | |
| 6,558,453 | B2 * | 5/2003 | Sepke et al. | 95/268 |
| 6,829,804 | B2 * | 12/2004 | Sepke | 15/347 |
| D521,137 | S * | 5/2006 | Khalil | D23/365 |
| 7,507,269 | B2 | 3/2009 | Murphy et al. | |

* cited by examiner

FOREIGN PATENT DOCUMENTS

DE 3325336 1/1985

*Primary Examiner* — David A Redding

(74) *Attorney, Agent, or Firm* — Hunton & Williams

(57) ABSTRACT

A vacuum cleaner dirt container having a chamber with an upper opening, and a removable filter element. The filter element has an upper portion with an opening and a peripheral edge that engages an upper edge of the chamber. A filter portion extends from the upper portion, and a handle extends across the opening. The filter portion extends into the chamber when the filter element is mounted thereto. Also provided is an upright vacuum cleaner with a base unit, body unit, and dirt chamber removably mounted to the body unit. A combined filter and lid is mounted to the dirt chamber, and includes a filter member, and a mounting ring extending from the filter member to a sidewall of the dirt chamber to hold the filtration device at a fixed location away from the chamber sidewall. Also provided is a cyclone lid having an annular wall, filter, and handle.

26 Claims, 8 Drawing Sheets

10
40
42
44
46
50
52
100
62
36
32
34
52a
54
102
60
29
30
74
28
76
70
72
22
14
80a
20
84
86
82
80

UPRIGHT VACUUM CLEANER WITH CYCLONIC AIR PATH

This application is a continuation of Ser. No. 11/758,824, filed Jun. 6, 2007, now U.S. Pat. No. 7,334,290, which is a continuation of U.S. application Ser. No. 11/281,796, filed Nov. 18, 2005, now U.S. Pat. No. 7,228,592, which is a continuation of U.S. application Ser. No. 10/430,603, filed May 6, 2003, abandoned, which is a continuation of U.S. application Ser. No. 09/759,391, filed Jan. 12, 2001, now U.S. Pat. No. 6,910,245, which claims the benefit of U.S. Provisional Application Ser. No. 60/176,374, filed Jan. 14, 2000, the entire contents of which are incorporated herein by reference in their entirety.

FIELD OF THE INVENTION

This invention relates to an improved upright vacuum cleaner having a cyclonic air path. More particularly, this invention relates to such a vacuum cleaner as provides the operator with improved performance features such as a visual indication of the condition of a removable filter to allow for more timely cleaning of such filter, an improved filter insertion and removal arrangement that allows for easy maintenance, as well as other improvements as will be described below.

BACKGROUND OF THE INVENTION

In selecting a vacuum cleaner for home use, consumers today have many choices including a choice between an upright and a canister style vacuum cleaner, a choice between a bagged or a bag less dirt collection, and, a choice between a cyclonic versus a non-cyclonic cleaning action. Typically, two very important factors in the consumer's decision regarding the purchase of a vacuum cleaner are the ease of use of the vacuum cleaner and its cleaning effectiveness. Based on these factors, the bag less style of upright vacuum cleaner has become popular recently because it no longer requires the unpleasant task of periodically changing vacuum cleaner bags. Instead, the consumer merely removes the dust cup or container and empties it over a trash receptacle. Occasionally, the consumer must also clean out a removable filter within the dust cup that traps smaller particles of dirt. One of the problems associated with the task of emptying the dust cup is that the top of the dust cup is typically open to the air thus allowing that dust previously vacuumed, can be released back into the air during the process of transporting the dust cup to the trash receptacle.

Another feature of today's bagless vacuum cleaners is that the dust cup or container is typically made of clear plastic so that the operator can observe the cleaning action of the vacuum cleaner. This visual effect lets the operator monitor the effectiveness of the cleaning action and determine when the container should be emptied or the filter cleaned. Examples of such bagless upright vacuum cleaners can be found in U.S. Pat. Nos. 6,146,434; 6,070,291; and, 5,558,697. The problem with relying on this visual assessment of the cleaning action is that most consumers may not realize when the cleaning effectiveness has deteriorated by simply viewing the cleaning action. In fact, the cleaning effectiveness is also dependent upon the condition of any filtering devices disposed in the airflow path and if such filter is clogged or dirty, the cleaning effectiveness of the vacuum cleaner can be compromised without the operator being able to visually detect such condition. Accordingly, it would be beneficial if a bagless upright vacuum cleaner provided some additional means for determining the cleaning effectiveness particularly with respect to any filter devices that may be included with the bagless vacuum cleaner.

Of further importance in the operation of such bagless vacuum cleaners is the actual task of removing and reinstalling the dirt-collecting chamber so that the dirt can be emptied into a trash receptacle. Often times the operator has to make several attempts to align the dirt-collecting chamber properly for continued operation. It would be advantageous if the bagless vacuum cleaner included a simple and easy to use arrangement for aligning and reinstalling the dirt collecting chamber following a routine exercise of emptying the chamber.

SUMMARY OF THE INVENTION

In one exemplary aspect, the present invention may provide a dirt container for a vacuum cleaner. The exemplary dirt container may have a chamber with an upper opening, a sidewall forming an upper edge that surrounds the upper opening, and an air inlet. A removable filter element is provided, and includes an upper portion having a central opening and a peripheral edge located radially outward of the central opening, a filter portion extending from the upper portion and having a proximal end attached to the upper portion to surround the central opening, and a handle extending across the central opening. The peripheral edge of the upper portion is adapted to selectively engage the upper edge of the chamber to attach the removable filter to the chamber. The filter portion extends into the chamber when the peripheral edge is engaged with the upper edge.

In another exemplary aspect, the present invention may provide a vacuum cleaner having a floor engaging base unit, a body unit pivotally mounted on the base unit, a dirt chamber removably mounted to the body unit, a fan adapted to create an air flow through the dirt chamber, and a combined filter and lid. The combined filter and lid is removably mounted to the dirt chamber, and has a filter member projecting into the dirt chamber and being adapted to allow the air flow to pass therethrough and remove particles from the air flow, and an air-impervious mounting ring extending a substantial distance from the filter member to a sidewall of the dirt chamber to hold the filter member at a fixed location away from the sidewall. The combined filter and lid is removable from the vacuum cleaner with the dirt chamber, is enclosed between the dirt chamber and the body unit when the dirt chamber is mounted to the body unit, and is adapted to convey the air flow vertically upward into the body unit after passing through the dirt chamber.

In another exemplary aspect, the present invention may provide a lid for a cyclone separator. The lid has an annular wall having a central opening and an outer perimeter dimensioned to engage a corresponding cyclone chamber. The central opening is substantially smaller than the outer perimeter. A filter covers the central opening, and a handle extends across the central opening. The handle is located on a side of the filter opposite the corresponding cyclone chamber.

BRIEF DESCRIPTION OF THE DRAWINGS

The invention will now be more fully described with reference to the accompanying drawings in which.

DETAILED DESCRIPTION OF THE INVENTION

Figure 1:
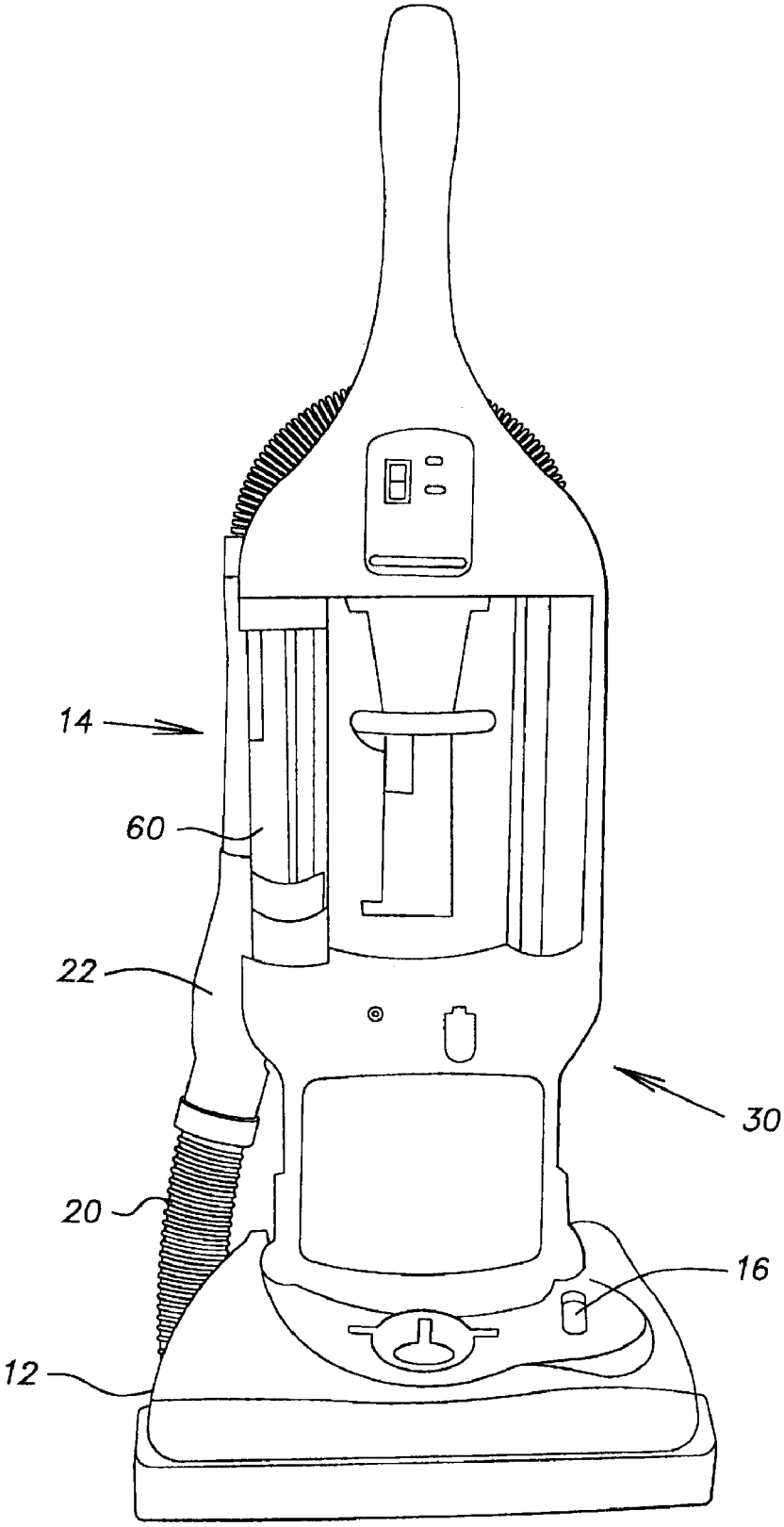
FIG. 1 is a perspective view of a front of the vacuum cleaner constructed in accordance with the present invention.

The present invention is directed toward an improved upright vacuum cleaner that has a plurality of cyclone filtration chambers and other mechanical filter means. The present invention uses progressive filtration wherein larger particles are removed first and then progressively smaller particles are removed from the air stream until, finally, very small particles are removed. As seen in FIG. 1, the vacuum cleaner of the present invention has a base 12, a rear housing 14 and an upstanding handle (see FIG. 3). The handle can be packaged separate and apart from the rear housing 14 and can be easily assembled by the user. The handle 10 includes a yoke or laterally split attachment arms that are inserted into accommodating recesses in the rear housing 14.

Figure 2:
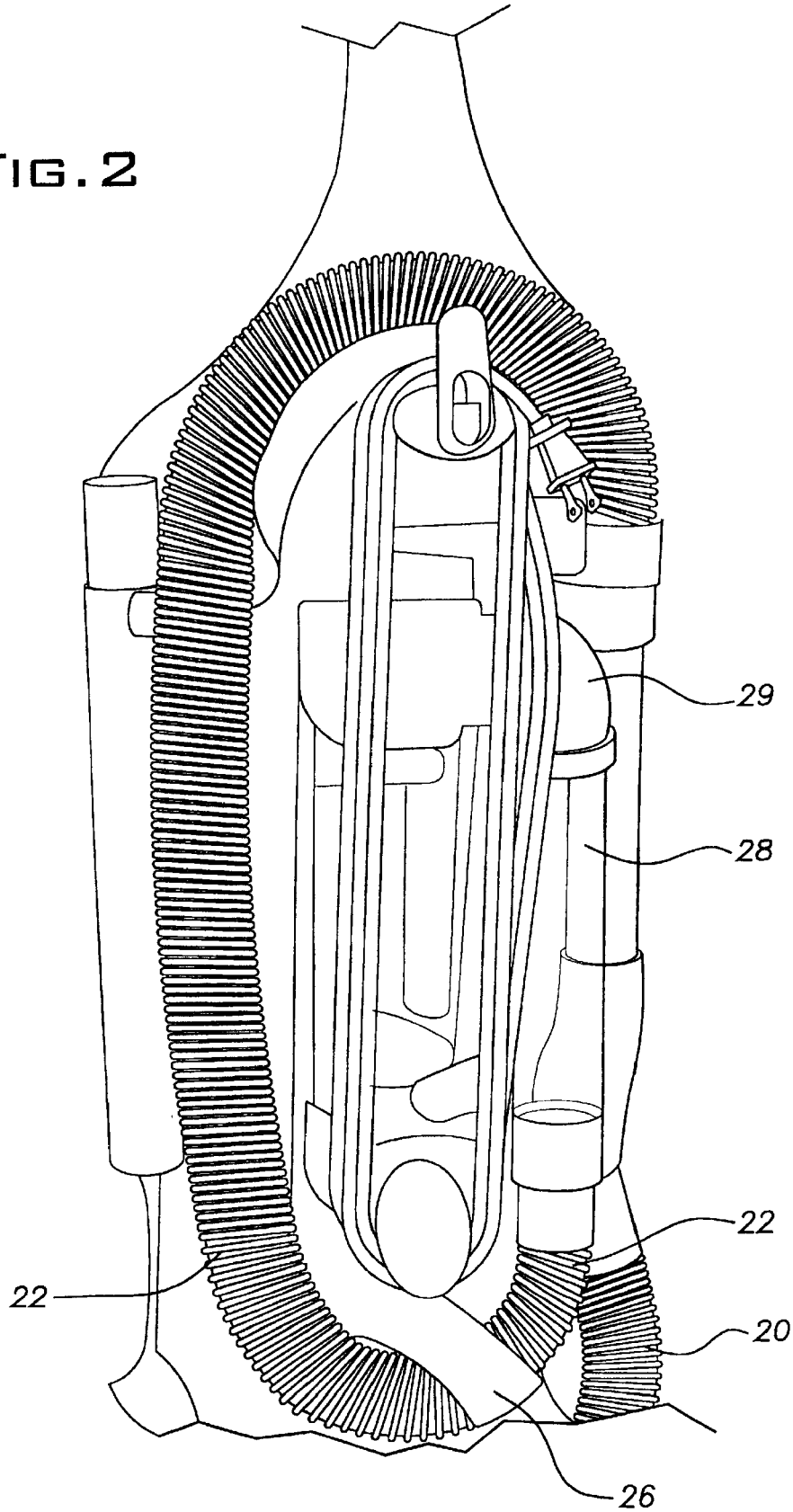
FIG. 2 is a perspective view of a rear of the vacuum cleaner constructed in accordance with the present invention.
Figure 3:
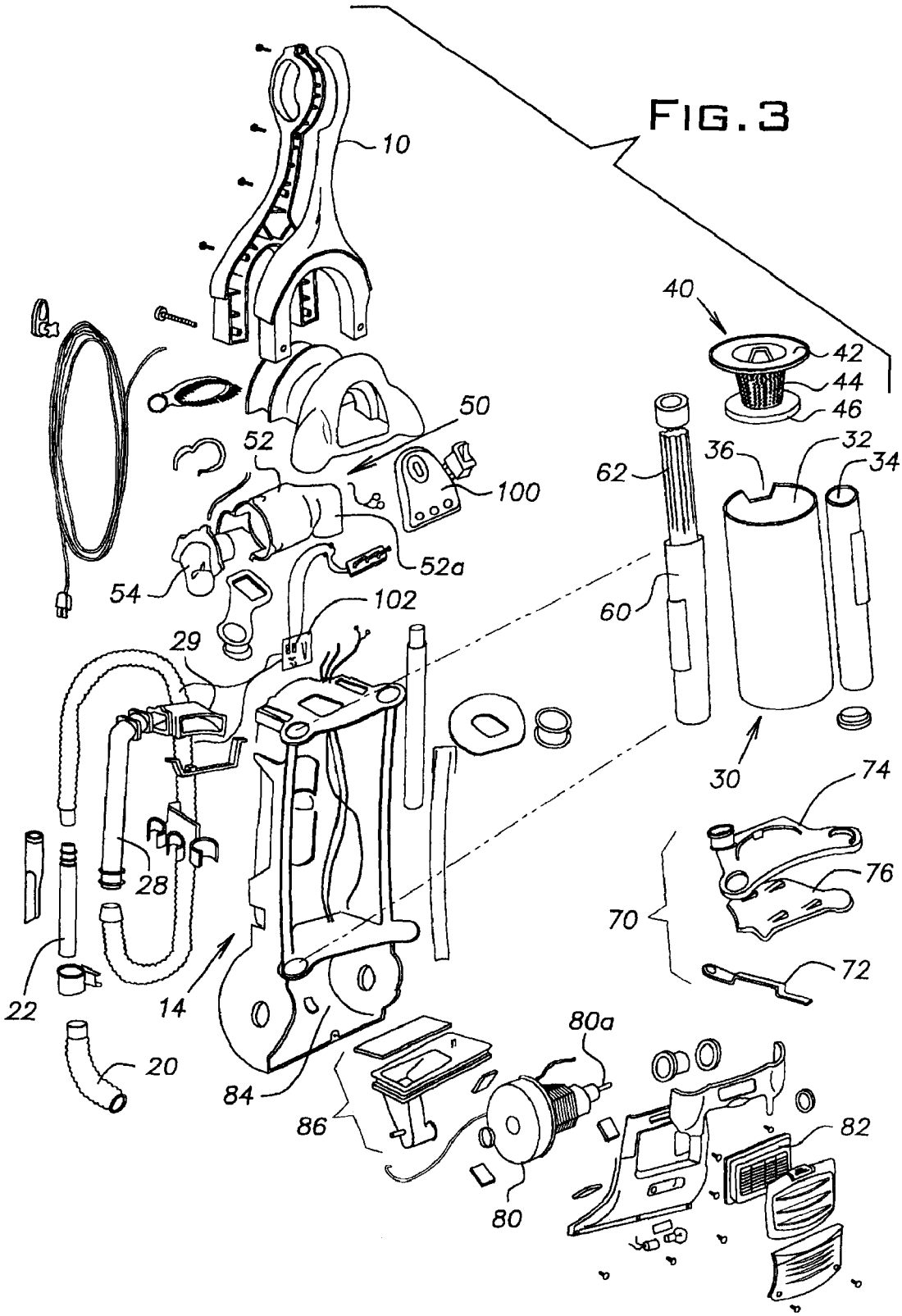
FIG. 3 is an exploded perspective view of the vacuum cleaner according to the present invention.

The base 12 includes a brush roll (not shown) that is selectively rotated by a drive belt (not shown), such brush roll and drive belt being constructed according to well known techniques. The drive belt is driven by a shaft 80*a* off of motor/fan assembly 80 as shown in FIG. 3. The motor 72 can be disposed in a bottom portion of the rear housing 14, which is rotatably connected to the base 12. Additionally, the motor/fan assembly 80 can be disposed in a plenum chamber 82 created by the air duct and rear housing/motor cover seal 86. The drive belt may be engaged/disengaged from the brush roll by operation of a pulley via a slide lever 16 to thereby disengage the brush roll as is desired when cleaning hard floor surfaces. As seen more clearly in FIG. 2, a tube 20 extends from the base 12 and communicates air and dirt upwardly from the base 12 to a hose 22. The hose 22 extends upwardly from the tube connection around a hose hook of a top rear portion of the rear housing 14 and down to the base of the rear housing 14 and under a hose retention member 26. The free end of the hose 22 connects to a first end of a conduit 28. The second end of the conduit 28 is connected to a dirt sensor housing 29.

The dirt sensor housing 29 extends from the conduit 28 to a rear portion of a dirt collecting enclosure 30 and acts as an input port so as to be sealingly engaged to the rear of the dirt collecting enclosure 30. The dirt sensor housing 29 can have gaskets molded or installed therein. Additionally, the dirt sensor housing 29 is formed having a bend therein so as to extend from a downwardly facing inlet to a laterally or horizontally facing outlet that is then connected to the rear portion of the dirt collecting enclosure 30. It would also be possible to achieve the benefits of the present invention if the inlet to the dirt sensor housing 29 were disposed in a horizontally; that is, oriented in the same manner as the horizontally facing outlet.

Figure 5:
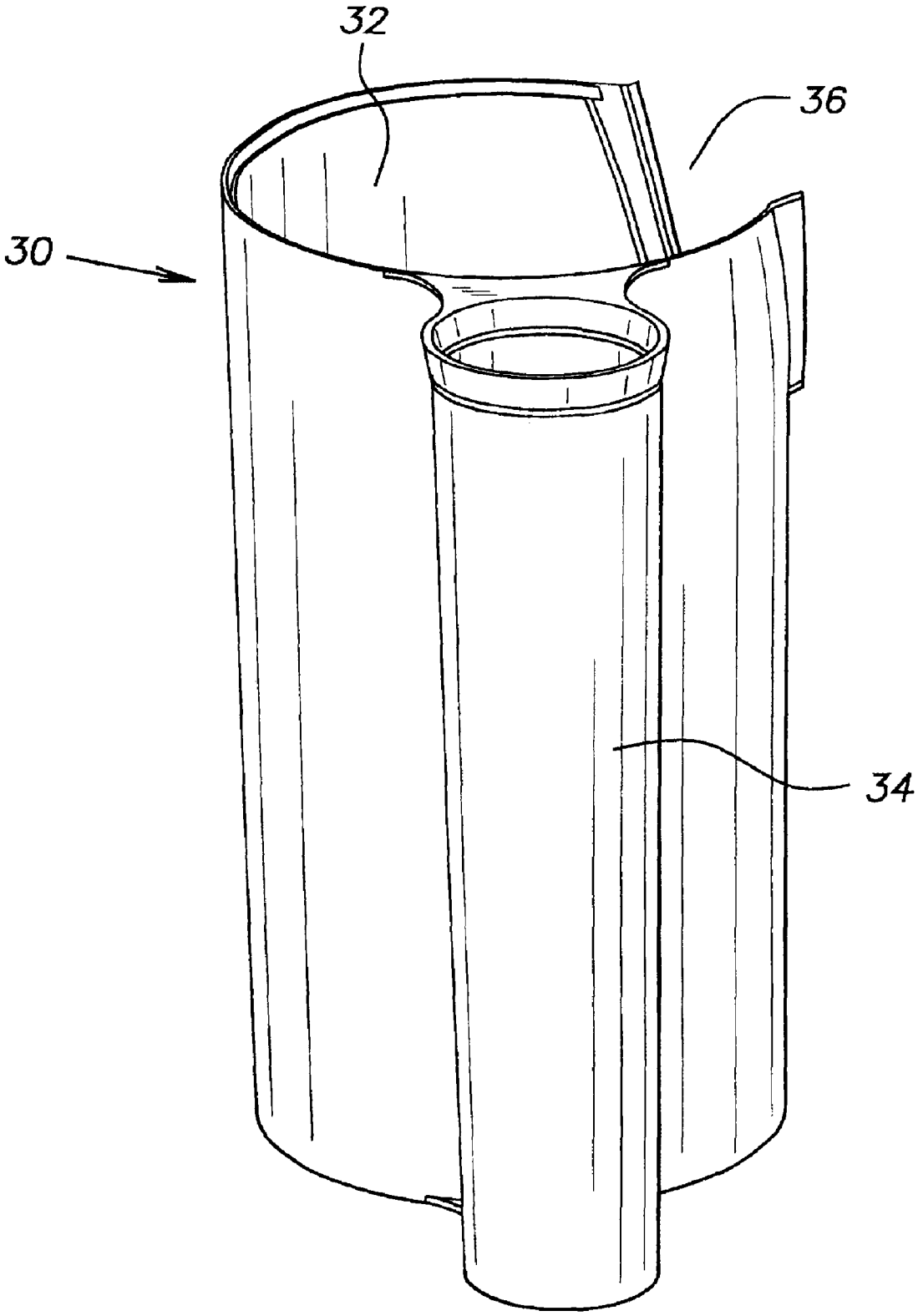
FIG. 5 is a perspective view of the dirt collecting enclosure portion of the present invention.

As seen in FIG. 5, the dirt collecting enclosure 30 has a first large chamber 32 and a smaller chamber 34. Air and dirt are introduced into the first large chamber 32 in a tangential manner to thereby achieve a cyclonic airflow. Each of the first and second chambers 32, 34 has an open upper end and a closed bottom side. The dirt sensor housing 29 sealingly engages a side of the large chamber 32 at a top end thereof and surrounds an input opening 36 to the large chamber 32. The input opening 36 is a notched opening at the top end of the first large chamber 32. Of course, the input opening to the first large chamber 32 can be disposed in the side of the large chamber 32 thereby allowing that the upper edge of the first large chamber is continuous about its circumference. An upper edge of the dirt collecting enclosure 30 at the first large chamber 32 includes a rim or ledge. A filter element 40 is disposed in the first large chamber 32 and is laterally adjacent the input opening 36.

Figure 6:
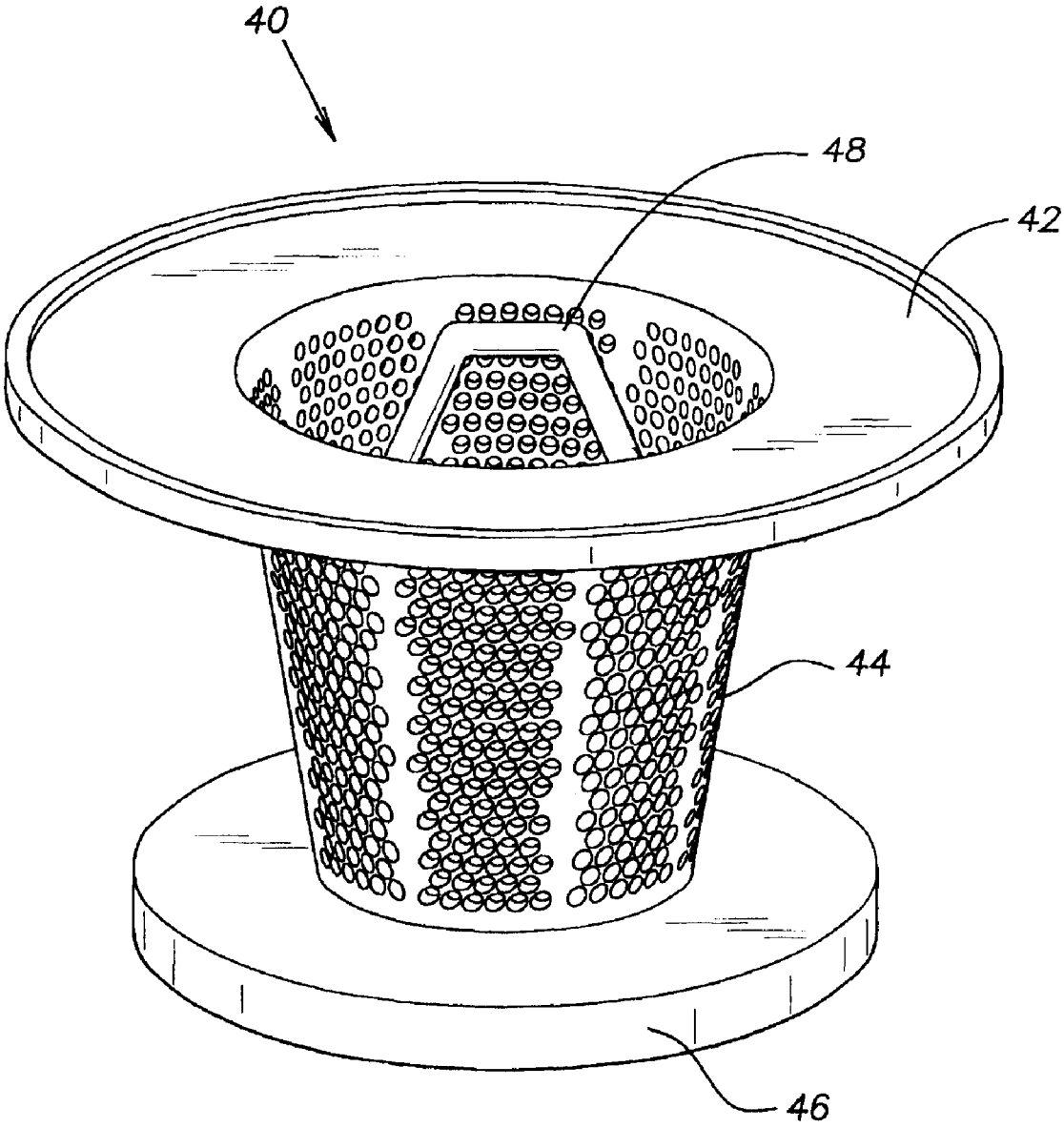
FIG. 6 is a perspective view of the filter element portion of the present invention.

As seen in FIG. 6, the filter element 40 includes an upper ring-shaped circular portion 42, a central frustoconical portion 44, and a lower ring-shaped portion 46. The upper ring-shaped portion 42 rests or is seated on the ring or ledge of the large first chamber 32 so that the body of filter 40 extends into the large first chamber 32. It should be noted that the upper ring-shaped portion 42 of filter 40 is effective for essentially closing off the large first chamber 32. This is particularly effective during the process of emptying the dirt collecting enclosure 30 in that the seating of the filter 40 of the upper opening of the first chamber 32 substantially reduces the occurrence of dirt escaping the dirt collecting enclosure 30 when the user is emptying the dirt collecting enclosure 30 into a trash receptacle. In this manner, the filter 42 acts as both a filter and a seal.

Figure 7:
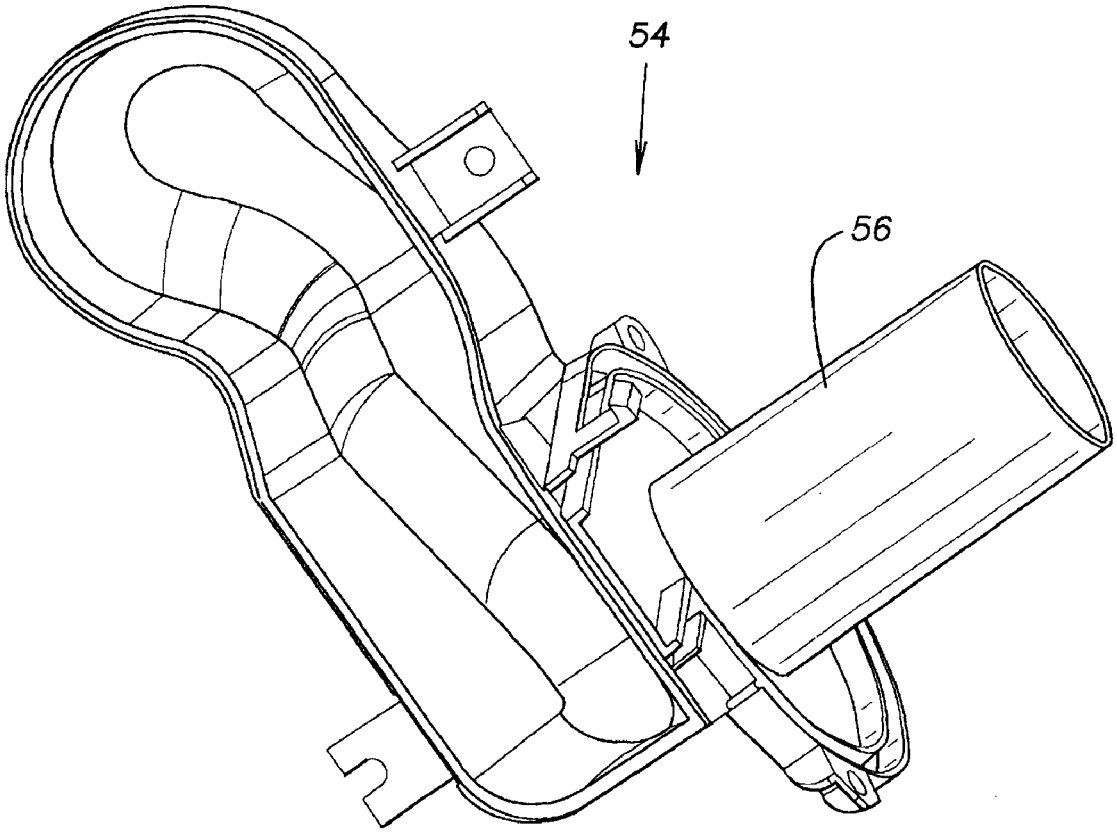
FIG. 7 is a perspective view of the end cap portion of the cyclone body of the present invention.
Figure 8:
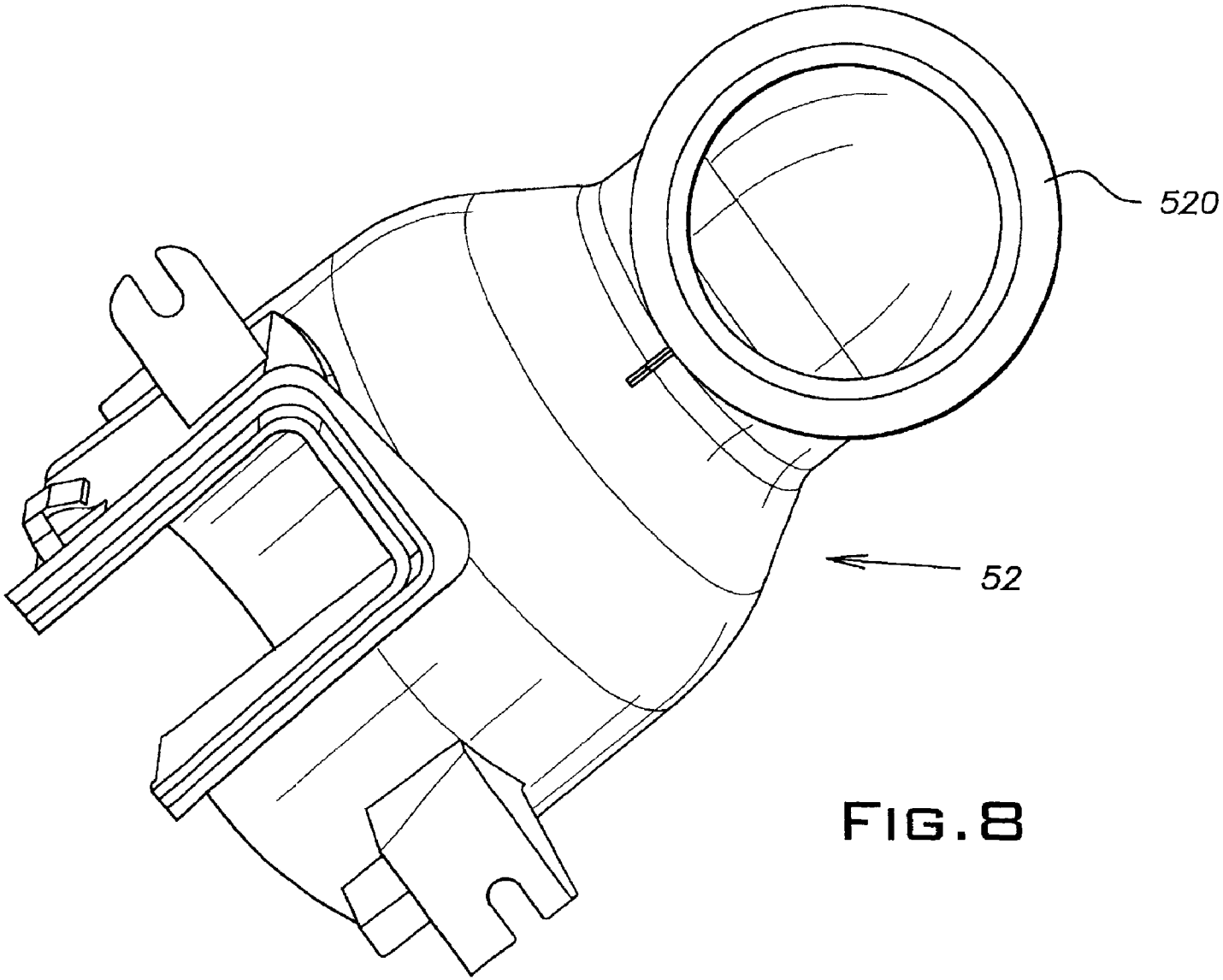
FIG. 8 is a perspective view of the cyclone body of the present invention.

The frustoconical portion 44 is perforated and serves as a filter surface. The lower ring shaped portion 46, which includes a downwardly extending peripheral flange, serves as a baffle plate and separator for larger particles that precipitate into the bottom of the first large chamber 32. Air from the first large chamber 32 flows through the filter member 40 and upwardly into a second cyclone 50 (see FIG. 3). The second cyclone is disposed relatively above the dirt collecting enclosure 30 and is operable to deposit or direct smaller dirt particles into the second chamber 34 of the dirt collecting enclosure 30. More specifically, relatively clean air from the first chamber 32 tangentially enters the second cyclone 50 and the cyclone chamber provided thereby via an inlet defined by the union of the cyclone body 52 and the cyclone end cap 54 (see FIGS. 7 and 8).

The cyclone body 52 includes a circular first body portion that merges into a downwardly extending tube portion 52*a*. The end of the tube portion 52*a* includes a flange and a neck, the neck extending into and sealing the second chamber 34 with the flange abutting the end face of the second chamber 34. Air is introduced tangentially into the second cyclone 50 and spirals around the neck and downwardly into the bottom of the second chamber 34 so as to carry the smaller particles of debris therewith. The clean air from the second chamber 34 exits via the outlet tube 56 provided by the cyclone end cap 54 and flows laterally across the vacuum cleaner body and into the top end of filter tube 60. The filter tube 60 is disposed substantially symmetrically on the opposite side of the first chamber 32 as the second chamber 34. More specifically, the air that enters a cylindrical filter member 62 disposed within filter tube 60, flows through the filter element 62 and exits via an outlet at the bottom of the filter tube 60. Air is communicated from the outlet of the filter tube 60 to the motor/fan assembly 80 and then to atmosphere via a HEPA filter 82.

As seen in FIG. 3, the vacuum cleaner includes an elevator assembly 70 that permits easy installation and sealing engagement of the dirt collecting enclosure 30 and filter tube 60 with the rear housing 14. The elevator assembly 70 is mounted to the rear housing 14 relatively beneath the dirt collecting enclosure 30 and filter tube 60 and includes a handle 72 that is laterally shifted or pivoted. Of course, other actuation mechanisms can be utilized as well and still achieve the benefits of the present invention. For instance, a rotatable knob can achieve the same actuation effect as the lever or handle 72. Movement of the handle 72 causes an elevator platform 74 to be moved up or down thereby either pushing the dirt collecting enclosure 30 and filter tube 60 up into sealing engagement with associated upper seals, or, permits the dirt collecting enclosure 30 and filter tube 60 to be dropped down and out of sealing engagement with the seals. Typically, the elevator assembly 70 will be moved to a lower position to permit removal of the dirt collecting enclosure 30 from the rear housing 14 for emptying, and will be moved to the upper position after the dirt collecting enclosure 30 and filter tube 60 are reinstalled to seal the assembly in position and permit further cleaning operations. A cam plate can also be provided as part of the elevator assembly 70 to achieve the raising and lowering functions. Of course, the cam operation need not be provided by a separate element but can be achieved by providing a camming surface on either the elevator platform 74 or the lever member 72. Additionally, though the present embodiment describes a mechanical arrangement for actuating the elevator, it is contemplated herein that the elevator arrangement could also be achieved by use of an electrical or pneumatic form of actuation.

The cyclone body 52 and cyclone end cap 54 cooperate to filter dirt from air and to transport clean air to another location of further processing. In this regard, it is important to note that the cyclone body 52 and the cyclone end cap 54 do not require a replaceable and removable filter element. The cyclone chamber defined by the cyclone body 52 is angled with respect to vertical, and extends downwardly and laterally from the upper end to the lower end. The lower end of the cyclone chamber bends still further downwardly such that the exit of the tube is essentially vertically oriented and therefore matches the orientation of the second chamber 34 and smoothly merges therewith.

The cyclone body 52 has a first edge adjacent its upper end that is engaged and sealed by the cyclone end cap 54. The cyclone end cap 54 preferably has a peripheral groove into which the first edge is inserted to form a labyrinth type seal. Naturally, additional sealing gaskets or seals may also be used. The connection between the cyclone end cap 54 and the cyclone body 52 also defines the inlet air passageway from the first chamber 32/filter element 40 to the second cyclone as noted hereinbefore. The end cap 52 and body 54 are also attached by cooperation of tabs and mechanical fasteners (not shown) about the first edge and the peripheral groove to ensure a sealing connection. The inlet passageway is generally tangential to the inner wall surface of the cyclone body 52, as illustrated.

Figure 4:
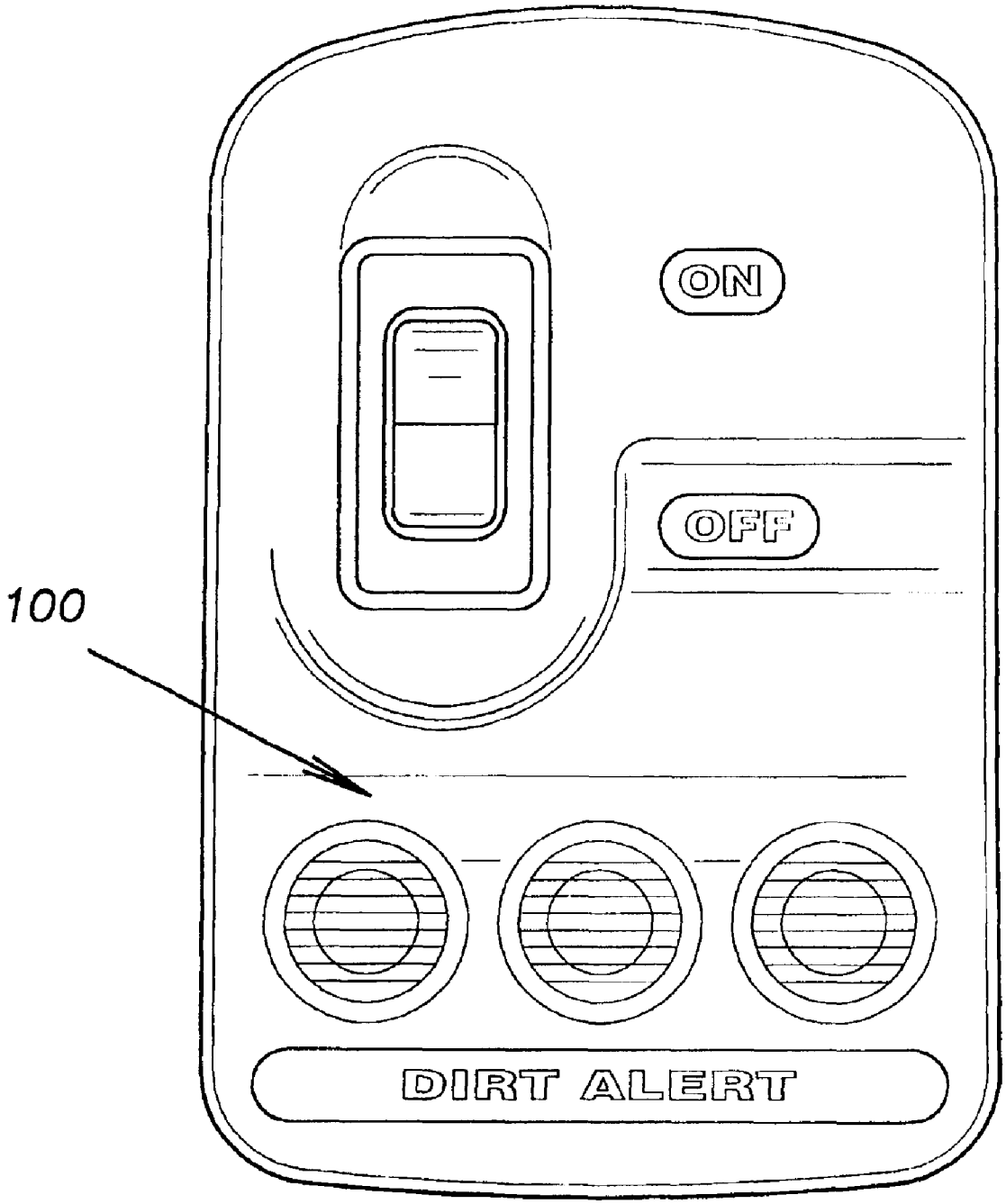
FIG. 4 is a front elevational view of a front of a vacuum cleaner showing dirt and filter condition indicators.

As seen in FIG. 4, adjacent the on-off switch, a series of indicator 100 are provided. The indicators can be LEDs that are illuminated to indicate the occurrence of a differential pressure across one or more of the filter elements, which is indicative of a clogged or dirty filter. The filter elements being sensed are preferably the HEPA filter and/or the tube filter element 62 downstream of the cyclone filter units. A circuit board 102 (see FIG. 3) with sensors extending therefrom into the airflow path, can perform the necessary detection and indication functions according to known techniques.

Although the hereinabove described embodiment of the invention constitutes the preferred embodiment; it should be understood that modifications could be made thereto without departing from the scope of the invention as set forth in the appended claims.

What is claimed is:

1. A dirt container for a vacuum cleaner, the dirt container comprising:

a first chamber having an upper opening, a sidewall forming an upper edge that surrounds the upper opening, and an air inlet;

a removable filter element comprising:

an upper portion having a central opening and a peripheral edge located radially outward of the central opening, a filter portion extending from the upper portion and having a proximal end attached to the upper portion to surround the central opening, and a lower portion attached to a distal end of the filter portion, wherein at least a portion of the lower portion extends radially from the filter portion, and wherein the lower portion comprises a peripheral flange extending away from the lower portion; and a handle extending across the central opening, wherein the peripheral edge of the upper portion is adapted to selectively engage the upper edge of the first chamber to attach the removable filter thereto, and wherein the filter portion extends into the first chamber when the peripheral edge is engaged with the upper edge.

2. The dirt container of claim 1, wherein the air inlet passes through the sidewall.

3. The dirt container of claim 1, wherein the air inlet comprises an indentation formed in the upper edge.

4. The dirt container of claim 1, wherein the upper portion substantially closes the upper opening when the removable filter is attached to the first chamber.

5. The dirt container of claim 1, wherein the filter portion has a frustoconical shape.

6. The dirt container of claim 1, wherein at least a portion of the handle lies in a plane defined by the upper portion.

7. The dirt container of claim 1, further comprising a second chamber, separate from the first chamber.

8. The dirt container of claim 7, wherein the removable filter element is adapted to selectively enclose only the first chamber.

9. The dirt container of claim 1, wherein the proximal end of the filter portion is non-removably attached to the upper portion.

10. The dirt container of claim 1, wherein the filter portion includes a concave space within the filter portion, and at least a portion of the handle is located in the concave space.

11. The dirt container of claim 1, wherein the handle comprises an arch shape.

12. The dirt container of claim 1, wherein the filter portion terminates at a lower portion, the lower portion lying in a first plane that is substantially parallel to a second plane defined by the upper portion of the removable filter element.

13. A dirt container for a vacuum cleaner, the dirt container comprising:

a first chamber having an upper opening, a sidewall forming an upper edge that surrounds the upper opening, and an air inlet, wherein the air inlet comprises an indentation formed in the upper edge;

a removable filter element comprising:

an upper portion having a central opening and a peripheral edge located radially outward of the central opening, a filter portion extending from the upper portion and having a proximal end attached to the upper portion to surround the central opening, and a handle extending across the central opening, wherein the peripheral edge of the upper portion is adapted to selectively engage the upper edge of the first chamber to attach the removable filter thereto, and wherein the filter portion extends into the first chamber when the peripheral edge is engaged with the upper edge.

14. A dirt container for a vacuum cleaner, the dirt container comprising:

a first chamber having an upper opening, a sidewall forming an upper edge that surrounds the upper opening, and an air inlet;

a second chamber, separate from the first chamber; and a removable filter element comprising:

an upper portion having a central opening and a peripheral edge located radially outward of the central opening, a filter portion extending from the upper portion and having a proximal end attached to the upper portion to surround the central opening, and a handle extending across the central opening, wherein the peripheral edge of the upper portion is adapted to selectively engage the upper edge of the first chamber to attach the removable filter thereto, and wherein the filter portion extends into the first chamber when the peripheral edge is engaged with the upper edge.

15. The dirt container of claim 14, wherein the filter portion further comprises a lower portion attached to a distal end of the filter portion, and at least a portion of the lower portion extends radially from the filter portion.

16. The dirt container of claim 15, wherein the lower portion comprises a peripheral flange extending away from the lower portion.

17. The dirt container of claim 14, wherein the air inlet passes through the sidewall.

18. The dirt container of claim 14, wherein the air inlet comprises an indentation formed in the upper edge.

19. The dirt container of claim 14, wherein the upper portion substantially closes the upper opening when the removable filter is attached to the first chamber.

20. The dirt container of claim 14, wherein the filter portion has a frustoconical shape.

21. The dirt container of claim 14, wherein at least a portion of the handle lies in a plane defined by the upper portion.

22. The dirt container of claim 14, wherein the removable filter element is adapted to selectively enclose only the first chamber.

23. The dirt container of claim 14, wherein the proximal end of the filter portion is non-removably attached to the upper portion.

24. The dirt container of claim 14, wherein the filter portion includes a concave space within the filter portion, and at least a portion of the handle is located in the concave space.

25. The dirt container of claim 14, wherein the handle comprises an arch shape.

26. The dirt container of claim 14, wherein the filter portion terminates at a lower portion, the lower portion lying in a first plane that is substantially parallel to a second plane defined by the upper portion of the removable filter element.

* * * * *